US008573278B1

(12) United States Patent
Cahilly et al.

(10) Patent No.: US 8,573,278 B1
(45) Date of Patent: Nov. 5, 2013

(54) WELL PLATE FILM APPLICATOR

(76) Inventors: Bambi Lyn Cahilly, Victorville, CA (US); Paul Chadwick, Santa Fe, NM (US); David Tostenson, Victorville, CA (US); Clementh Moser, Victorville, CA (US)

( * ) Notice: Subject to any disclaimer, the term of this patent is extended or adjusted under 35 U.S.C. 154(b) by 570 days.

(21) Appl. No.: 12/459,562

(22) Filed: Jul. 2, 2009

Related U.S. Application Data

(60) Provisional application No. 61/129,541, filed on Jul. 2, 2008.

(51) Int. Cl.
*B32B 37/22* (2006.01)

(52) U.S. Cl.
USPC ..... 156/577; 156/579

(58) Field of Classification Search
USPC ..... 156/574, 577, 579
See application file for complete search history.

(56) References Cited

U.S. PATENT DOCUMENTS 4,525,237 A * 6/1985 Clar ..... 156/540
5,358,113 A * 10/1994 Hellenbrand ..... 206/411
5,551,564 A * 9/1996 Prater et al. ..... 206/409
D394,206 S * 5/1998 Morrish ..... D9/417
5,878,457 A 3/1999 Cox et al.
5,940,921 A 8/1999 Wood et al.
6,431,242 B1 * 8/2002 Irons ..... 156/542
6,612,474 B2 * 9/2003 Shah ..... 225/51
D558,272 S * 12/2007 Goldman et al. ..... D19/69
D570,227 S * 6/2008 Goodman et al. ..... D9/730
2002/0056526 A1 * 5/2002 Kelders et al. ..... 156/577
2005/0056377 A1 * 3/2005 Tominaga ..... 156/540
2005/0150604 A1 * 7/2005 Smits et al. ..... 156/510
2007/0006974 A1 * 1/2007 Gruber ..... 156/577
2007/0221336 A1 * 9/2007 Crawford et al. ..... 156/577

FOREIGN PATENT DOCUMENTS

WO WO 2010088848 A1 * 8/2010

OTHER PUBLICATIONS

Machine Translation of Chinese Patent CN101486850, Jianbing, Sep. 2009.*

* cited by examiner

*Primary Examiner* — Mark A Osele
(74) *Attorney, Agent, or Firm* — Theodore J. Bielen, Jr.

(57) ABSTRACT

A film applicator device for use on a wellplate utilizing a roll of film having an adhesive side. The applicator includes a support for a roll wound by a sheet of film material which lies within a chamber. The chamber includes a mouth with a notch to allow the grasping of the film in order to pay the film outwardly from the chamber.

8 Claims, 3 Drawing Sheets

WELL PLATE FILM APPLICATOR

CROSS-REFERENCES TO RELATED APPLICATION

The present application is intended to obtain the benefit of provisional application 61/129,541, filed 2 Jul. 2008.

BACKGROUND OF THE INVENTION

The present invention relates to a novel and useful film applicator device for use on a microplate, microtiter plate, or a wellplate.

Microtiter plates are used in analytical research and clinical diagnostic testing. For example, microtiter plates allow the conducting of enzyme-linked immunosorbent assays (ELISA) in the diagnostic testing of humans and animals. Microtiter plates typically have any number of samples of wells arranged in a generally rectangular matrix. Most common wellplate is the 96 well-microtiter plate. Analytical or diagnostic samples are placed in each of the wells of the microtiter plate to carry out filtration, separation, optical detection, storage, reaction mixing, cell culturing activities, and the like.

In certain cases, microtiter plates may be heat sealed with foil or clear film to prevent contamination, cross-contamination, and evaporation of materials therefrom. In the past, sheets of polymeric material or metallic foil have been placed over the open wells of the microtiter plates to achieve this result. Unfortunately, such plastic films are difficult to handle and to place atop a microtiter plate for sealing. This is due to the fact that such films are quite thin and tend to fold or wrinkle when handled.

In the past, devices have been developed to handle rolls of sheet material. For example, U.S. Pat. Nos. 5,878,457 and 5,940,921 have been employed in this regard in the removal of lint from cloth.

A film applicator device for use on a microtiter plate utilizing a roll of film material would be a notable advance in the clinical and analytical research field.

BRIEF SUMMARY OF THE INVENTION

In accordance with the present invention a novel and useful film applicator device for use with a microtiter plate is hereinafter described.

The applicator device of the present invention utilizes the first element and a second element. The first element is hingedly or rotatably attached to the first element to form a housing. The housing includes a chamber having a mouth leading thereto when the first and second elements mate. The chamber is employed to enclose a sheet of film material having an adhesive side, wrapped about a roll. A support for the roll holding the film material is located in the chamber and allows the rotation of same relative to the chamber when the film material is pulled or payed out from the sheet of film material.

A notch extends through the housing at the mouth of the chamber and allows the user to easily grasp the film being unwound from the roll. In addition, a plurality of protuberances on the second element lie within the housing chamber. Such protuberances limit the holding capacity of the adhesive side of the film unraveled from the roll of film. In general, each of the plurality of protuberances are rounded in order to avoid damage to the film in contacting the plurality of protuberances.

Further, at least one latch having a flange pivotally moves relative to the housing and includes a portion which is capable of removably engaging the housing. The latch would maintain the positioning of the first element relative to the second element in the formation of the housing chamber. Likewise, unfastening of the latch permits access to the film material wound about the roll.

Moreover, a ridge formed on said housing and extends from the second element outside the housing chamber. Such ridge may be used to smooth the film taken from the roll after it has been applied to a microtiter plate. It should be noted that such ridge may be molded or attached to the applicator device of the present invention during construction of the same.

The device may also be fashioned to include at least one projection extending from the first element in order to bear on the roll holding film material within the chamber when the housing is squeezed or pressured. In this manner, the one projection would serve as a brake to the unwinding of the film from the roll of film.

The film wound on the roll may also be formed into multiple sheets. Separating multiple sections of the film sheet are intermediate sections lacking adhesive as. A frangible portion lies between at least a first and second section, adjacent the intermediate section lacking adhesive. In this manner, sections may be easily detached from the film sheet wound about the roll and applied to a microtiter plate.

It may be apparent that a novel and useful film applicator device for use on a microtiter plate has been hereinabove described.

It is therefore an object of the present invention to provide a film applicator device for use on a microtiter plate which easily and conveniently applies a film to a microtiter plate to prevent outside contamination, cross-contamination, and evaporation, of the contents in any of the wells of the microtiter plate.

Another object of the present invention is to provide a film applicator device for use on a microtiter plate which includes multiple sheets that are separable from a sheet of film wrapped about a roll and which are easy to apply to a microtiter plate.

Another object of the present invention is to provide a film applicator device for use on a microtiter plate in which the film does not include release layers or liners adjacent to the adhesive side of the same.

Yet another object of the present invention is to provide a film applicator device for use on a microtiter plate which is especially applicable to the handling of biohazardous materials.

Another object of the present invention is to provide a film applicator device for use on a microtiter plate which encloses a sheet of film wound about a roll when not in use and allows the unwinding or paying out of film material from such roll in a safe and convenient manner.

Yet another object of the present invention is to provide a film applicator device for use on a microtiter plate which is portable and minimizes the contact of adhesive on the film by the operator of the device.

The invention possesses other objects and advantages which will become apparent as the specification continues.

For a better understanding of the invention reference is made to the following detailed description of the preferred embodiments of the invention which should be taken in conjunction with the above described drawings.

DETAILED DESCRIPTION OF THE PREFERRED EMBODIMENTS OF THE INVENTION

Various aspects of the present invention will evolve from the following detailed description of the preferred embodiments thereof which should be referenced to the prior described drawings.

Figure 1:
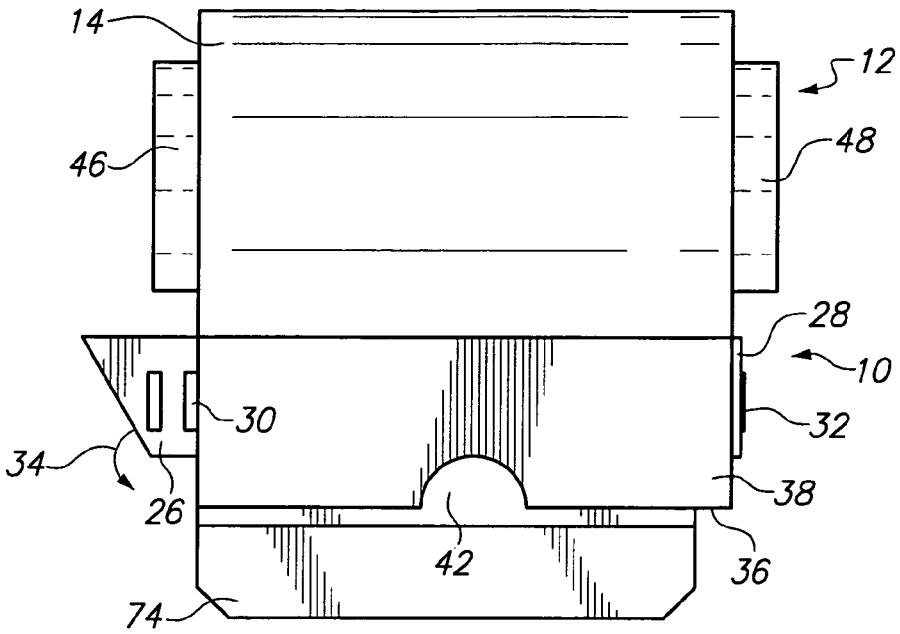
FIG. 1 is a top plan view of the device of the present invention showing one latch in its outward unlatched position.

An embodiment of the invention as a whole is shown in the drawings by reference character 10, FIGS. 1-4. Device 10 includes as one of its elements a housing 12. Housing 12 is formed with a first element 14 and a second element 16 which are hingedly or rotatably fixed to one another via hinge 18. Hinge 18 is formed of any suitable flexible material such as plastic, elastomeric material and the like, shown in FIG. 2. Directional arrows 20 and 22 indicate the direction of separation between first element 14 and second element 16 to allow access to chamber 24 formed within housing 12. Tabs or latches 26 and 28, rotationally held to second element 16, engage or snap to extensions 30 and 32 which are fixed to the side of housing 12, specifically fixed to first element 14. Tab 28 is depicted in FIG. 1 as being rotated downwardly into engagement with extension 32 while tab 26 is shown extended outwardly from housing 12. Directional arrow 34 indicates the downward rotational movement of tab 26 to engage extension 30. Needless to say, tabs 26 and 28 lock first element 14 to second element 16 to enclose chamber 24 within housing 12.

Figure 2:
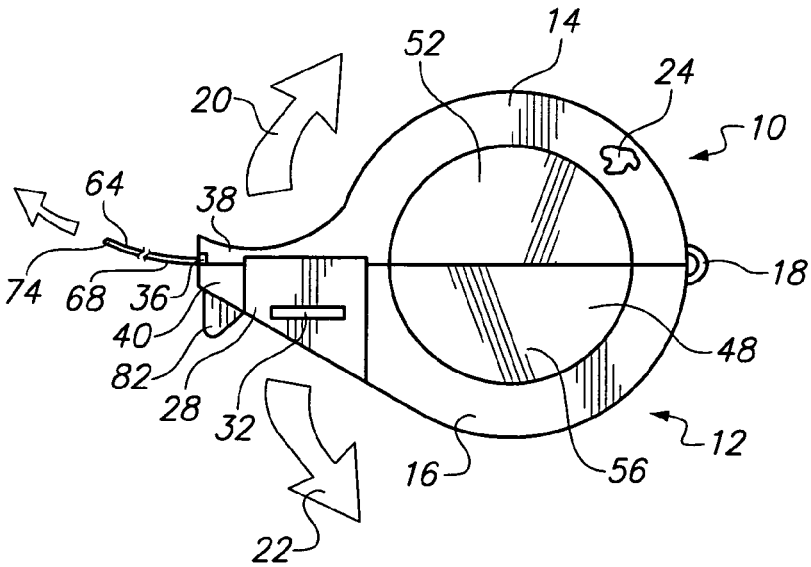
FIG. 2 is a side elevational view of the device of FIG. 1, indicating the separation of the first and second elements of the housing.
Figure 3:
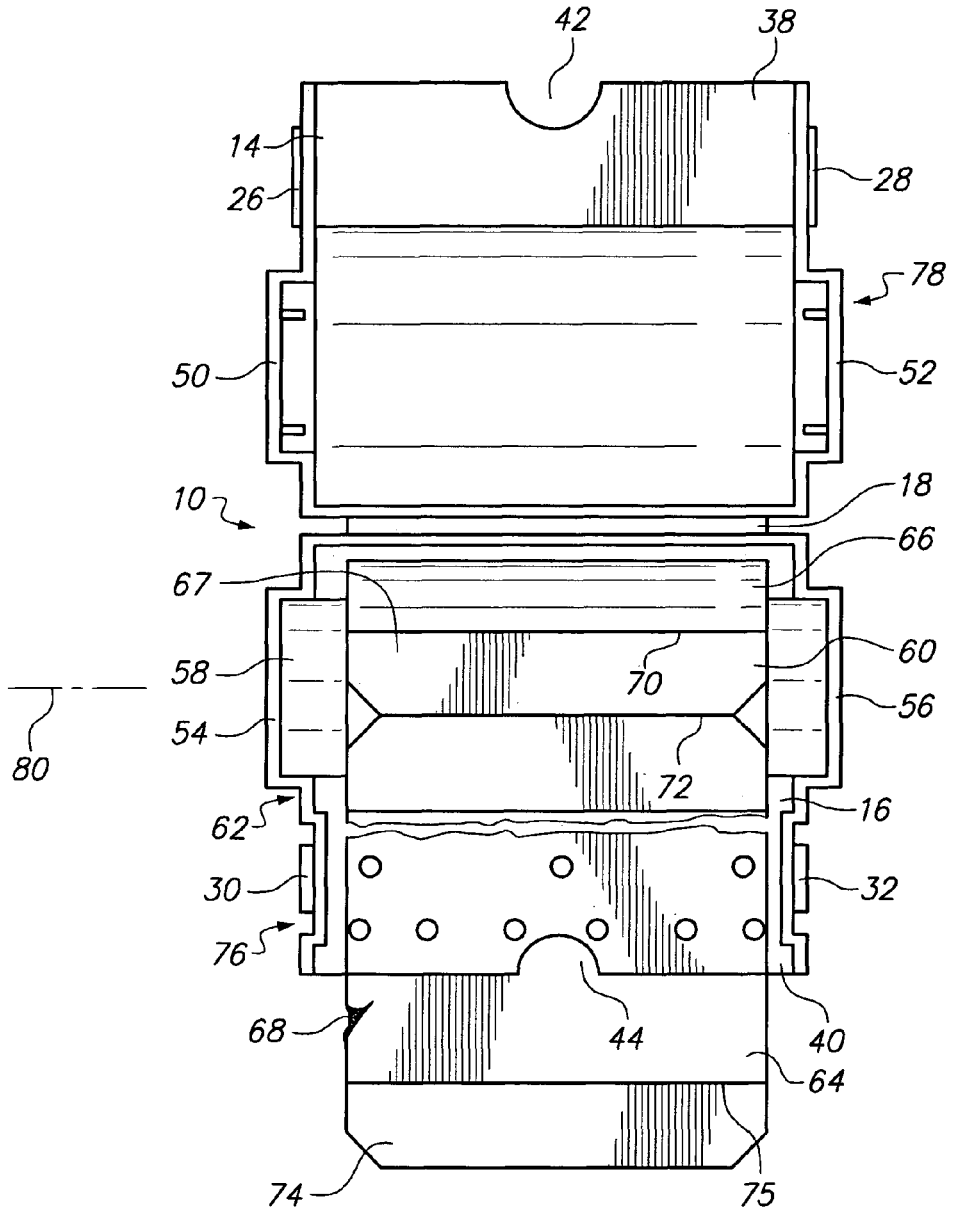
FIG. 3 is a top plan view of the device of the present invention in its open configuration, revealing the housing chamber and showing the film material with its adhesive side down.

Housing 12 is also formed with a mouth 36, FIG. 2, which leads directly into chamber 24. The end portions 38 and 40 of first and second elements 14 and 16, respectively, are formed with notches 42 and 44, respectively, FIGS. 1-3. In addition, housing 12 includes cylindrical bosses 46 and 48 which are formed by the mating of first element 14 with second element 16. With reference to FIG. 3, it may be observed that semi-cylindrical bosses 50 and 52 of first element 14 travel downwardly with the convergence of first and second element 14 and 16, and mate with semi-cylindrical bosses 54 and 56 of second element 16 in order to form cylindrical bosses 46 and 48.

Looking now at FIGS. 1-4, it may be further apparent that device 10 is used in conjunction with a roll 58 wound with a sheet of film material 60. Film material 60 is constructed with a plurality of removable sections 62, best shown in FIG. 3. For example, section 64 is depicted as being connected to section 66.

Each section of plurality of sections 62 includes an adhesive side. For example, section 64 of film material includes an adhesive side 68, FIGS. 1-3. In addition, an intermediate section 67 lies between sections 64 and 66. Intermediate section 67 includes no adhesive or adhesive that has been deactivated and is meant to be handled by the user of film material wrapped about roll 58. In addition, perforations 70 and 72 allow for the easy severing of sheets 64 and 66 from one another, as well as the removal of intermediate section 67 therefrom. In addition, it may be observed that section 74 lies at the end of section 64, FIGS. 1-3, and also includes no adhesive. It should be realized that section 74 either represents the beginning of sheet film material 60 or was once attached to an adjacent adhesive bearing sheet which has been removed from sheet of material 60. Moreover, sections 67 and 74 may be marked or colored for easy identification by the user. Roll 58 is intended to fit within cylindrical bosses 46 and 48 of housing 12 formed by the mating of first element 14 with second element 16, specifically the mating of semi-cylindrical bosses 50 and 54 with semi-cylindrical bosses 52 and 56, prior described.

A plurality of protuberances 76 extend upwardly from second element 16 within chamber 24. As depicted in FIG. 3, plurality of protuberance 76 are intended to engage adhesive side 68 of film section 64. Plurality of protuberances 76 include rounded ends that diminish the adherence of adhesive layer 68 with second element 16 when sheet of film material 60 is unwrapped from roll 58 during employment of the same, which will be described hereinafter. It should also be seen in FIG. 3 that first element 14 includes a plurality of projections 78 which are located on the portion of first element 14 lying within chamber 24. Plurality of projections 78 are intended to engage roll 58 when first element 14 mates with second element 16, serving as a brake to the turning of roll 58 about axis 80. Thus, such brake controls the unwinding of sheet of film material 60 from roll 58. Ridge 82 across housing 12, specifically across first element 16, is used to contact any of plurality of sections 62 of sheet of film material 60 after egress from chamber 24, which will be described hereinafter.

Figure 4:
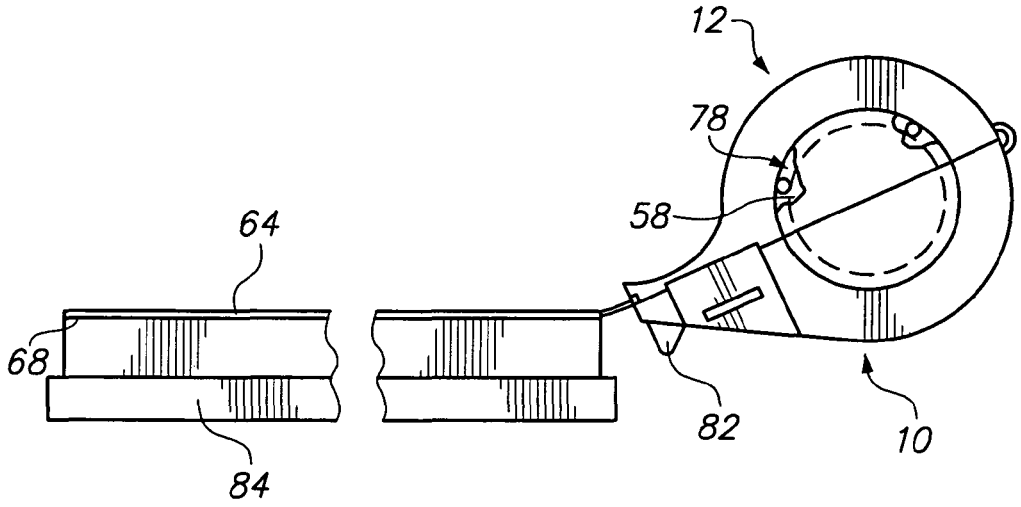
FIG. 4 is a side elevational view of the device of the present invention as used on a microtiter plate.
Figure 5:
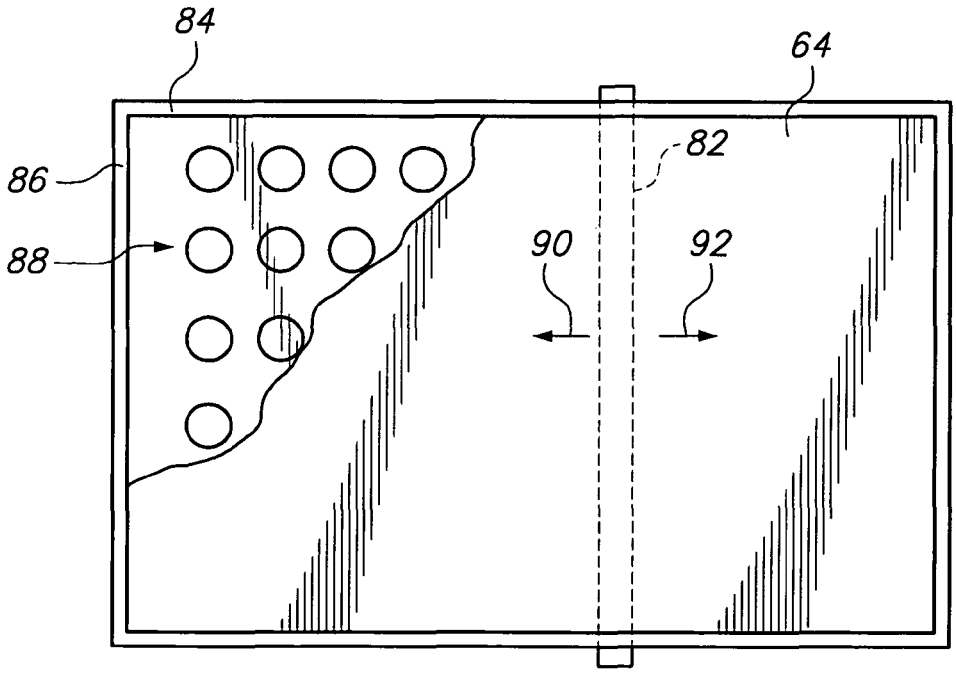
FIG. 5 is a top plan view of the device of the present invention showing a film section in place on a microtiter plate and the smoothing ridge depicted in phantom.

In operation, device 10 is employed to apply any of a plurality of sections 62 of sheet of film material to a microtiter plate 84, FIGS. 4-5. It should be realized that sheet of film material 60 may take the form of any transparent, translucent, opaque, material which may be impervious to moisture. For example, polyester, polypropylene, and the like would suffice in this regard. As depicted in FIG. 4, section 64 has been applied to microtiter plate 84 by the placement of its adhesive side on rim 86 of microtiter plate 84. The user grasps section 74 at notches 42 and 44 of housing 12 to unwind section 64 from film material sheet 60. Plurality of protuberances 76 prevent the fixing of the adhesive side of section 64 to second element 16 at this juncture. Needless to say, multiplicity of wells 88 lie within microtiter plate 84 and are covered by section 64 of sheet of film material 60 to isolate the same. Following application of section 64 atop microtiter plate 84, section 64 is severed from sections 66 via the perforation 72. End section 74 is also removed from section 64 via perforation 75. Ridge 82 is then pressed against rim 86 of microtiter plate with sheet 64 therebeneath. Section 64 seals atop of microtiter plate 84 in this manner. Directional arrows 90 and 92 indicate the movement of ridge 82 relative to microtiter plate 84, FIG. 5. It should also be realized that plurality of projections 78 on first element 14 control the unwinding of sheet of material 60 from roll 58 during this process and the rate of unwinding may be increased or diminished by the application of pressure on the exterior surface of housing 12. Latches or tabs 26 and 28 may be snapped open to gain access to chamber 24 of housing 12 in order to replenish or manipulate sheet of material on roll 58, as needed.

While in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. An applicator system for covering a microtiter plate comprising:

a. a first element having a first end portion and a second end portion;

b. a second element having a first end portion and a second end portion, said first and second elements being rotatably attached to one another to form a housing, said housing including a chamber having a mouth leading thereto;

c. a roll;

d. a support for holding and permitting turning of the roll in said chamber;

e. a sheet of film material being wrapped about said roll, said roll having a portion extending laterally from said wrapped sheet of film material; and f. at least one projection extending from said first element, said one projection bearing on said roll portion extending laterally from said sheet of film wrapped about said roll upon the application of force on said housing.

2. The device of claim 1 in which said sheet of film wrapped about said roll includes a first section having an adhesive side, a second section having an adhesive side, and an intermediate section connecting said first and second sections, said intermediate section lacking an active adhesive side.

3. The device of claim 2 which said sheet of film further includes a frangible portion between said first and second sections adjacent said intermediate section lacking an active adhesive side.

4. The device of claim 1 which further includes a notch extending through said housing at said mouth of said chamber.

5. The device of claim 4 which further comprises a plurality of protuberances on said second element within said housing chamber.

6. The device of claim 5 in which each of said plurality of protuberances are oriented to contact the adhesive side of the roll of film material.

7. The device of claim 1 which further comprises a ridge extending from said second element outside said housing chamber.

8. The device of claim 1 which further comprises a latch, said latch including a flange pivoting relative to said housing, said flange engaging said housing.

* * * * *